US008720895B2

(12) United States Patent
Matthis

(10) Patent No.: US 8,720,895 B2
(45) Date of Patent: May 13, 2014

(54) PORTABLE ARCHERY TARGET SUPPORT

(76) Inventor: Bradley Matthis, Oregon City, OR (US)

( * ) Notice: Subject to any disclaimer, the term of this patent is extended or adjusted under 35 U.S.C. 154(b) by 217 days.

(21) Appl. No.: 13/324,913

(22) Filed: Dec. 13, 2011

(65) Prior Publication Data

US 2013/0147118 A1 Jun. 13, 2013

(51) Int. Cl.
*F41J 1/10* (2006.01)
*F16M 11/24* (2006.01)

(52) U.S. Cl.
USPC ..... 273/407; 273/408; 248/432; 248/188.7

(58) Field of Classification Search
USPC ..... 273/403–410; 248/163.1, 163.2, 440.1, 248/188, 165–173, 188.7, 164, 431, 432
See application file for complete search history.

(56) References Cited

U.S. PATENT DOCUMENTS

| | | | | | |
|---|---|---|---|---|---|
| 215,033 | A * | 5/1879 | Wright et al. | ..... | 273/407 |
| 366,833 | A * | 7/1887 | Hipwell | ..... | 248/431 |
| 664,976 | A * | 1/1901 | Sheffy et al. | ..... | 248/431 |
| 2,368,740 | A * | 2/1945 | Blomgren | ..... | 108/154 |
| 2,828,097 | A * | 3/1958 | Faunce | ..... | 248/106 |
| 2,899,204 | A * | 8/1959 | Rattay | ..... | 273/392 |
| 3,137,522 | A * | 6/1964 | Smith | ..... | 108/186 |
| 4,120,280 | A * | 10/1978 | Iverson et al. | ..... | 126/30 |
| 4,423,849 | A * | 1/1984 | Jordan | ..... | 248/165 |
| 4,717,108 | A * | 1/1988 | Liedle | ..... | 248/432 |
| 5,029,795 | A * | 7/1991 | Dexter | ..... | 248/431 |
| 5,145,133 | A * | 9/1992 | France | ..... | 248/168 |
| 7,172,512 | B2 * | 2/2007 | Be | ..... | 472/118 |
| 7,581,703 | B1 * | 9/2009 | Coleman et al. | ..... | 248/163.2 |
| 7,946,588 | B1 * | 5/2011 | Hockman et al. | ..... | 273/406 |
| 2003/0173477 | A1 * | 9/2003 | FitzSimons | ..... | 248/166 |

* cited by examiner

*Primary Examiner* — Mark Graham

(74) *Attorney, Agent, or Firm* — Peter A Haas Esquire LLC

(57) ABSTRACT

A portable archery target support having at least three legs that can be arranged asymmetrically, the legs being dowels or simple tubes; with a non-rigid target suspension feature and stabilizers to prevent the target from swinging or turning excessively after an arrow strike.

10 Claims, 4 Drawing Sheets

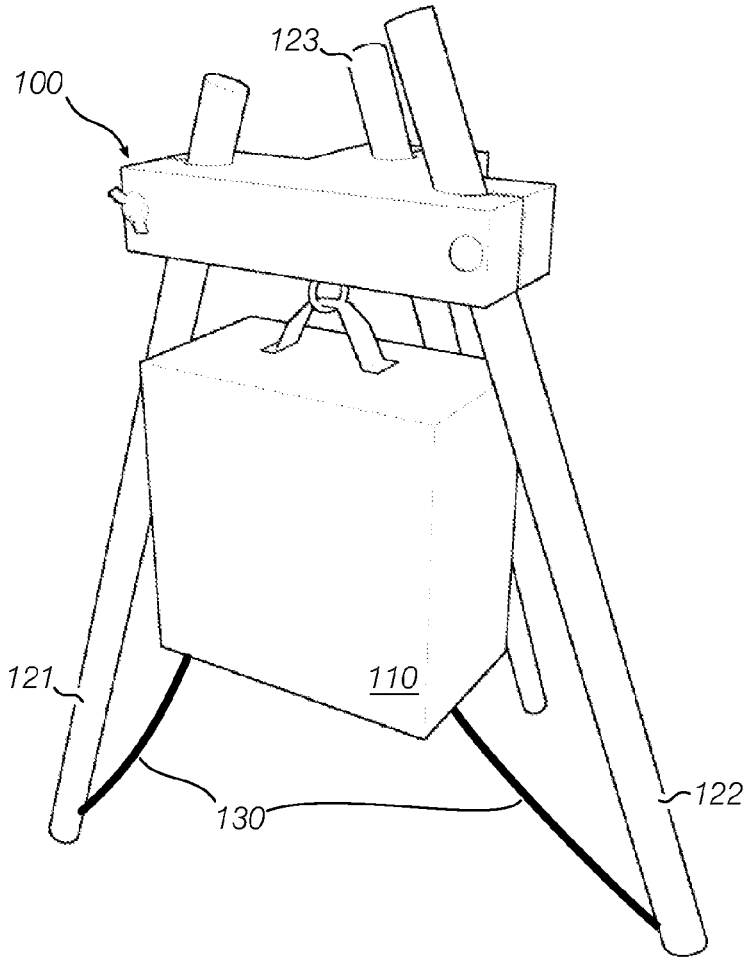
Fig. 1
Fig. 2
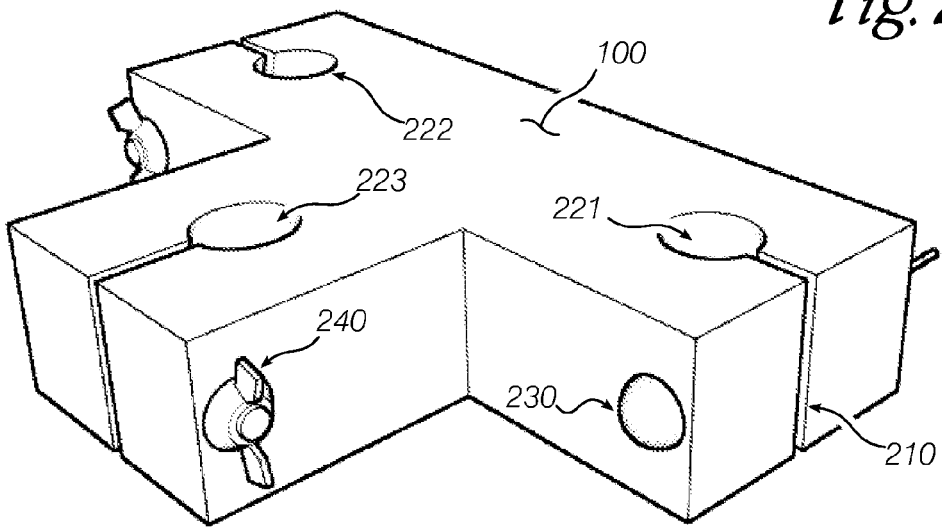

PORTABLE ARCHERY TARGET SUPPORT

CONTINUITY AND CLAIM OF PRIORITY

This is an original U.S. patent application.

FIELD

The invention relates to archery and archery targets. More specifically, the invention relates to sturdy, portable support structures for use with archery targets.

BACKGROUND

Development of archery skills involves practice, often involving shooting at a commercially-available target. Common target materials include: foam, newspaper, fused polyurethane and polyethylene. Targets are built to absorb repeated shots (often on two, four or even six sides) and allow for easy removal to avoid damage to arrow tips. Most targets are square or rectangular in shape and weigh between 15 and 25 pounds, include a top handle for easy carrying and are covered by an all-weather poly material. Common sizes include: 24"×12"×24", 18"×14"×18" and 18"×16"×11". Target stands provide stability to the target during shooting. However, most commercially available stands are not suitable for holding a target on uneven terrain, like a forest floor. Additionally, most are not light weight and cannot be disassembled for ease of transport if the shooter decides to practice in a different location.

A sturdy, adjustable and lightweight archery target stand that can be disassembled and adjusted with only primitive tools will be useful for shooters who wish to practice shooting in a remote location with uneven terrain. A stand comprised of components that are readily available allows for ease of repairs and adjustment.

SUMMARY

Embodiments of the invention include variations on securing the removable stand legs to the target mounting block ("mount"), which include: split flange, tapered insert, finger joint insert, finger jointed or spiral groove support leg, high friction finish on the support leg, hose clamp securement, set screw securement, and a two piece mount that tightens against the legs. An additional embodiment allows for multiple leg angles and leg positions to accommodate uneven terrain and allow optimal access to target without blocking by one of the legs.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

FIG. 1 shows many common features of an embodiment.

FIG. 2 shows the split flange method of leg securement to a T-shaped mount.

FIG. 5 details the leg hole and method of securement using a tapered insert.

FIG. 6 details the leg hole and method of securement utilizing a finger joint finish in the mount.

FIG. 7 details the leg hole and method of securement using a finger jointed or spiral grooved finish on the support leg.

FIG. 8 details the leg hole and method of securement where a high friction finish is applied to the support leg.

DETAILED DESCRIPTION

Figure 3:
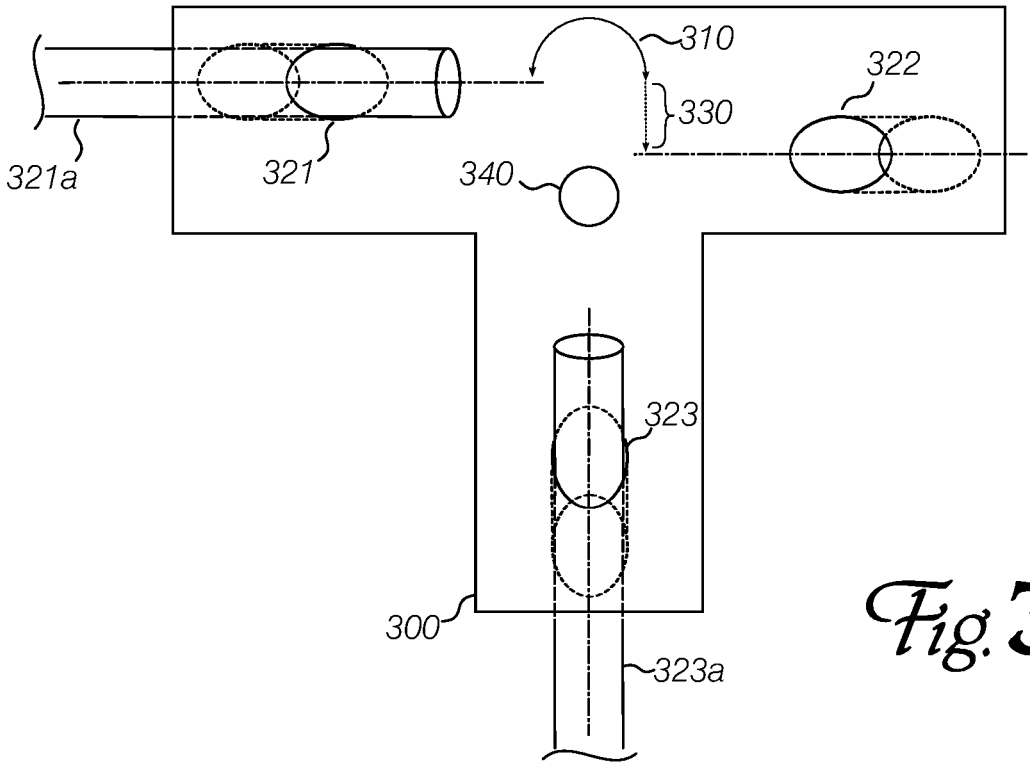
FIG. 3 details the angled and offset holes for leg securement and location in a T-shaped mount.

An early prototype embodiment of the archery target mount comprises the T-shaped split flange design shown in FIG. 2, but the target legs can be secured to the mount by additional methods, including those listed below. Suitable configurations of the mounting block include a T-shaped design and a two-piece round shape. Variations on support leg securement include embodiments for securing the support legs via the mounting block and embodiments where the support legs themselves provide the means of securement to the mounting block. In the embodiments described herein, the material for mount 100 may be a HDPE-like material, but polycarbonate or wood mounts are also functional. Metal is less suitable for the mounting block as it would be excessively heavy for transporting the target support to a remote location and may cause damage to arrows if they strike the mount. The mounting block should be made of a strong, tough, resilient material that is easy to clean, and preferably one that can be colored as desired (for example, in camouflage or high-visibility colors). A preferable overall thickness of mounting block is 1½". Unlike typical tripod structures, the target mount is fixed and not capable of rotating and tilting. Three removable legs 121, 122, 123 provide for ease of transport and adjustment when setting up the target stand. Preferable leg materials include those that are durable, yet easily replaceable in the event of damage, such as standard sized wood dowels or aluminum tubing. Preferable leg diameter is ⅜", but could be as large as 1⅛". A preferable method of securing target 110 to the mounting block includes hanging the target by its handle to eyebolt 420 that is secured to the bottom of the mounting block through opening 340.

Embodiments for securing the legs to the assembly via the mount include: the split flange design, tapered insert, finger joint insert, two piece mount assembly, and set screw securement.

FIG. 2 shows the mount 100 in a T-shaped design with split flanges to secure the legs. The mounting block is split 210 by removing material from the outside edge to leg holes 221, 222, 223. Preferable hole diameter 221, 222 and 223 is ⅜" to 1⅛", according to the corresponding leg diameter. Leg securement occurs by tightening the mount against the leg with through bolt 230. Wing nut 240 permit tool-less adjustment of the legs.

Figure 5:
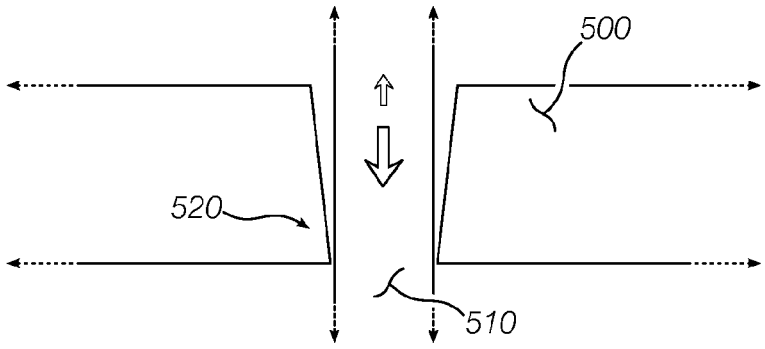
FIGS. 5-8 show various methods of securing the legs using the target mount.

FIG. 5 details a tapered hole to accept the leg. A variation in leg hole diameter between the top and bottom of the target mount 500 allow leg 510 to become secured as it is inserted through the top of the mount and contacts the mount at the smaller diameter 520. The legs may be removed by pushing them all the way through the hole. This method of securement can be used for the T-shaped and circular shaped mounts, as well as embodiments of other shapes.

Figure 6:
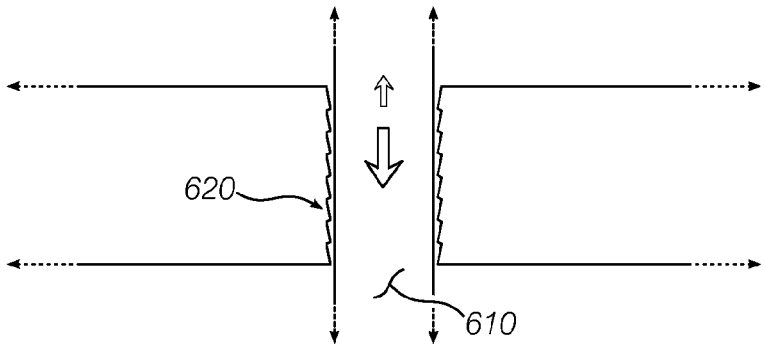

FIG. 6 details the finger joint method of leg securement. The hole is constructed with finger joint 620 to provide a friction fit for leg 610 as it is inserted through the top of the mount. The size and shape of the finger joint varies according to mount and leg material. This method of securement can be used for both the T-shaped and circular shaped mounts.

Figure 9:
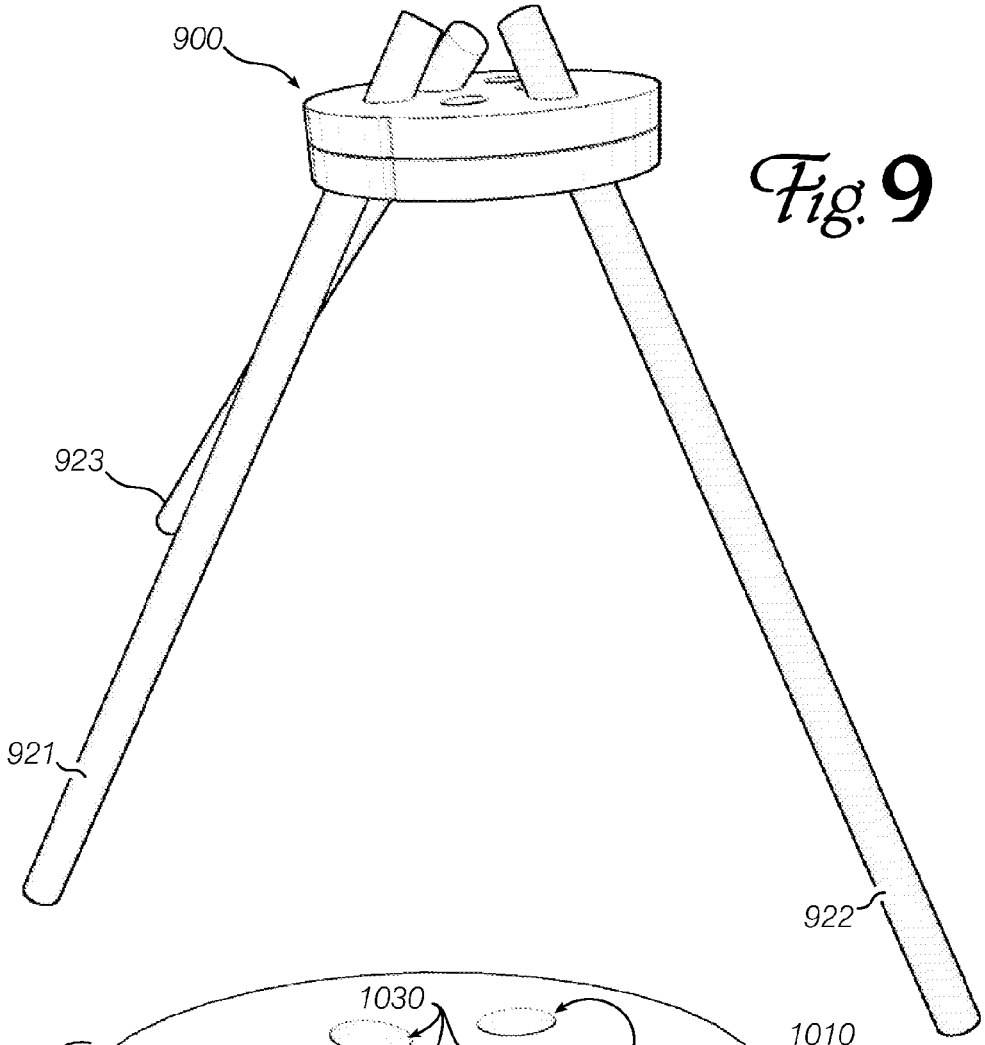
FIG. 9 shows a two-piece mount assembly that secures the legs by turning one of the pieces to tighten against the legs, acting as a sort of chock against the leg. A through bolt that compresses the mounts together provides a means of securement.
Figure 10:
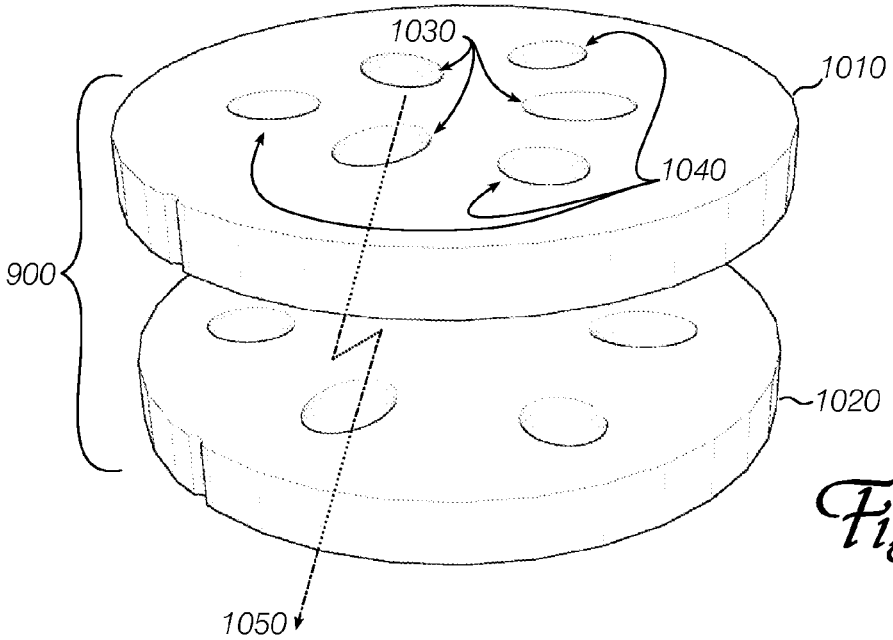
FIG. 10 provides a detail of the two piece mount showing multiple leg locations and angles to accommodate uneven terrain and allow optimal access to target without interference from the legs.

FIGS. 9 and 10 show a two piece, circular mount assembly. Mount plates 1010 and 1020 have corresponding holes 1050 that allow for leg insertion. The legs are secured by turning plate 1010 relative to plate 1020, wedging the legs in place. The turned mount acts as a chock against legs 921, 922, and 923 when it is turned until it cannot move. The two mount plates can then secured in position by a through bolt that tightens 1010 and 1020 to each other. A wing nut provides a preferable method of tightening.

The mount can also provide leg securement with the addition of a set screw or bolt that protrudes through the mount flange into the leg opening. Unscrewing the bolt allows for leg installation; once the desired leg position is achieved, the bolt can be turned until it just contacts the support leg and prohibits movement. Preferred set screws include thumb screws that are easy to turn with one hand and ideal for parts that are frequently removed. This method of securement is a useful alternative for the T-shaped mount.

Embodiments for assembling the legs to the mount via the legs include: finger joint or spiral groove finish on support leg, a high friction finish on the support legs and hose clamp securement.

Figure 7:
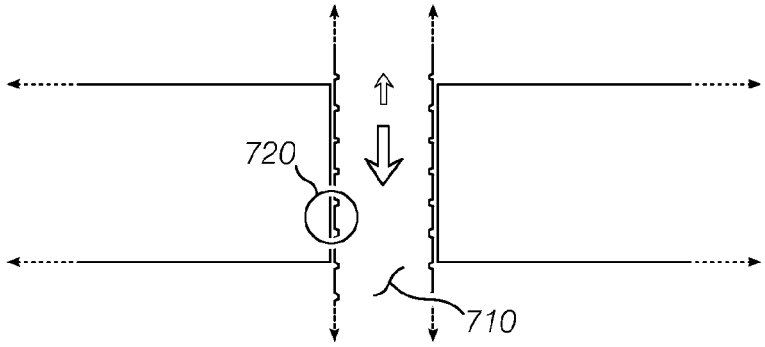

FIG. 7 shows a finger joint or spiral groove support leg 710 that provides a friction fit for the leg as it is inserted through the top of the mount and contacts the mount hole. The size and shape of the support leg texture 720 varies according to mount and leg material. A preferable shape for the support leg finish is a spiral groove.

Figure 8:
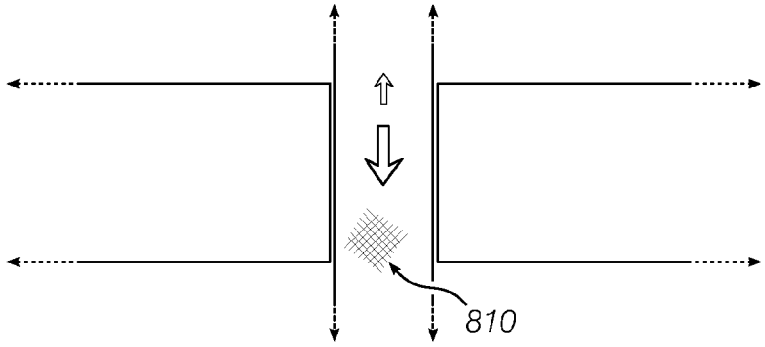

FIG. 8 details a friction fit where a leg has a high friction finish 810 providing leg securement as the leg is inserted through the mount hole. Preferable finishes include: lacquer, shellac and epoxy.

The archery target can also be assembled by installing spring clips (e.g., hose clamps) to the support legs on at least one side of the target mount holes. The clamps will provide a semi-rigid method of leg securement that is capable of providing some movement to the legs as the clamp is moved away from the mount leg opening. Preferred clamps include rotor clamps, which do not require tools for installation or adjustment.

Figure 4:
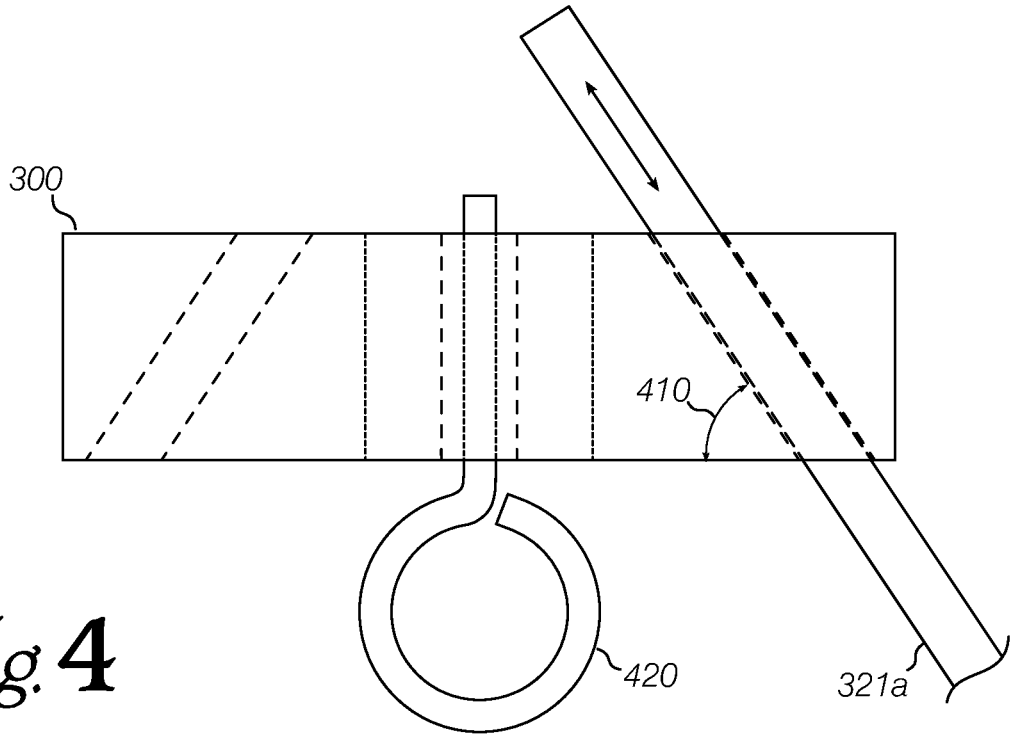
FIG. 4 provides an additional view of the angled holes and shows the method of attachment for the target to the mount.

Leg position and angle vary among the embodiments. FIGS. 3 and 4 show plan and front details of T-shaped mount 300. Leg holes 321, 322 and 323 are angled to provide target support without obstructing the target during shooting. Preferable angles 410 vary from 30° to 45°. Additionally, the centerlines of holes 321 and 322 may be offset (see 330) from each other so that legs 321*a* and the leg that would be inserted in hole 322 (leg not shown) do not interfere with each other on the top of the mount once assembled. Unlike a standard tripod, the angle of the legs need not be adjustable, and the legs need not telescope (telescoping legs may be heavier, more expensive and more prone to damage). In embodiments of the invention, the angled holes allow for leg adjustment by moving the legs either up or down through the mounting block. This method of adjustment allows the target mount to be set up at a location where the ground is uneven, and allows for removal of the legs for ease of transport. Additionally, unlike tripods which have legs that are equidistant from one another (e.g., arranged at 120° for a three-legged tripod), legs 321*a* and the opposing leg in hole 322 (leg not shown) are at about 180° (see reference character 310), while leg 321*a* is positioned at about 90° to leg 323*a*. Preferable hole diameter for 321, 322 and 323 varies from ⅜" to 1⅛", according to the leg size to be used.

FIGS. 9 and 10 show a two piece mount assembly that secures the legs by acting as a chock when the at least three legs are inserted through the mount plate holes (see line 1050) and then one of the mount plates (1010 or 1020) is twisted relative to the other until it tightens against the legs. Mount plates 1010 and 1020 may have multiple holes at various angles to adapt the target mount to uneven terrain. For example, in this figure, holes 1030 are at angles of 45°, while holes 1040 are at angles of 30° (from the horizontal). The variation in leg angle and position allows for optimal setup of the target support based on terrain and needed accessibility to the target.

It is preferred that the mechanism for suspending the target from the mount block (e.g., eye bolt 420 in FIG. 4) be loosely or non-rigidly mounted to the block. For example, hole 340 (FIG. 3) may be oversized with respect to the shank of eye bolt 420. Having a small amount of "play" or "give" in this part of the mount allows the target to move slightly when struck with an arrow. Even slight movement can dissipate some of the arrow's energy, which reduces the energy to be dissipated by the target block material and prolongs the useful life of the target block. In addition, as shown in FIG. 1 at 130, it is preferred to have stabilizing shock cords to help resist target swinging and spinning. Again, shock cords 130 do not hold the target rigidly in place, but allow it to move in response to an arrow strike; but nonetheless return the target to its rest position quickly in preparation for the next shot.

The applications of the present invention have been described largely by reference to specific examples and in terms of particular physical structures. However, those of skill in the art will recognize that portable target supports can also be constructed in different forms without departing from the principles of the present invention. Such variations are understood to be captured according to the following claims.

I claim:

1. A portable archery target support comprising:

a T-shaped support block formed of a tough, resilient polymer material, said support block having three cylindrical holes formed near each terminal end of its shape, axes of said cylindrical holes approaching one another above a plane of the support block and diverging from one another below the plane of the support block;

split flange slots to connect a cylindrical hole with an exterior edge of the support block, said slots substantially perpendicular to the plane of the support block;

pinch bolts at each slot to compress the slot and constrict a corresponding cylindrical hole;

three cylindrical support legs to pass through the three cylindrical holes, said support legs sized so that they cannot pass easily through the cylindrical hole when the corresponding split flange is tightened;

a target support loosely connected to the support block between the cylindrical holes, said target support for suspending an archery target between the cylindrical support legs below the plane of the support block; and stabilizing shock cords to connect two bottom corners of the archery target to lower ends of two cylindrical support legs, said shock cords to deter the archery target from swinging and rotating excessively after an arrow strikes the target.

2. The portable archery target of claim 1 wherein the support block is made from high density polyethylene.

3. The portable archery target of claim 1 wherein the support block is approximately one and one-half inches (38 mm) thick.

4. The portable archery target of claim 1 wherein a crossbar of the T shape is approximately 4 inches (100 mm) long, and an upright of the T shape is approximately 6 inches (150 mm) long.

5. The portable archery target of claim 1 wherein the axes of the cylindrical holes splay at approximately 45° from a normal to the plane of the support block.

6. The portable archery target of claim 1 wherein a diameter of the three cylindrical legs is between approximately ⅜ inch (9.5 mm) and approximately 1⅛ inch (28.6 mm).

7. The portable archery target of claim 1 wherein the three cylindrical legs are wooden dowels.

8. The portable archery target of claim 1 wherein the three cylindrical legs are aluminum tubes.

9. The portable archery target of claim 1 wherein the target support comprises an eye bolt secured to an oversized hole in the support block.

10. A portable archery target support comprising:

a support block having at least three substantially cylindrical holes, at least two of which pass completely through the support block, axes of said cylindrical holes angled so that the axes approach one another above the support block and diverge from one another below the support block;

a target connection feature attached loosely to the support block and positioned to suspend a target between the axes of the cylindrical holes below the support block; and support clamping means in each of the at least two through holes, said support clamping means to secure support legs inserted through the at least two through holes;

wherein each support clamping means comprises:

a slot in the support block extending from a side of a corresponding cylindrical hole to an outer surface of the support block, said slot oriented to be substantially coplanar with the axis of the corresponding cylindrical hole; and a threaded tensioning mechanism oriented substantially orthogonal to the slot, said threaded tensioning mechanism operative to pinch a material of the support block together at the slot and reduce a diameter of the corresponding cylindrical hole.

* * * * *